United States Patent [19]

Chornet et al.

[11] Patent Number: 4,895,577

[45] Date of Patent: Jan. 23, 1990

[54] LOW SEVERITY PEAT DEWATERING PROCESS

[75] Inventors: Esteban Chornet, Sherbrooke; Ralph P. Overend, Ottawa, both of Canada

[73] Assignee: Canadian Patents and Development Limited/Societe Canadienne des Brevets et D'Exploitation Limitee, Ottawa, Canada

[21] Appl. No.: 274,423

[22] Filed: Nov. 21, 1988

[30] Foreign Application Priority Data

Nov. 23, 1987 [CA] Canada ..... 552494

[51] Int. Cl.[4] ..... C10F 5/00; E21C 49/00

[52] U.S. Cl. ..... 44/33; 37/3

[58] Field of Search ..... 44/27, 33; 37/3

[56] References Cited

U.S. PATENT DOCUMENTS 1,290,494 1/1919 Ten Bosch et al. ..... 44/33

FOREIGN PATENT DOCUMENTS 1183685 3/1985 Canada ..... 44/33

231592 4/1925 United Kingdom ..... 44/33

*Primary Examiner*—Carl F. Dees

*Attorney, Agent, or Firm*—Burke-Robertson

[57] ABSTRACT

A continuous, low severity process for dewatering peat. The process comprises the steps of flowing a slurry of peat through a reactor directly heated by the addition of live steam to heat the slurry to a temperature of between 160° C. to 200° C., subjecting the heated slurry to intense mechanical shear and mixing, and then, after a period of between 1 to 3 minutes, quenching the product.

7 Claims, 3 Drawing Sheets

LOW SEVERITY PEAT DEWATERING PROCESS

FIELD OF THE INVENTION

The present invention relates to a process for dewatering peat and more particularly relates to a continuous thermo-mechanical process for treating raw peat to remove therefrom significant amounts of water so that the peat may be more readily transported and utilized.

BACKGROUND OF THE INVENTION

Peat is a carbonaceous resource which occurs very extensively in Canada and other circumpolar countries. It is also found in many topical countries where appropriate conditions of high water content and absence of oxygen allow the accumulation of decaying biomass. As a result peat in situ is often extremely wet and may contain less than 5% by weight of solid material. In order to transport and utilize peat, it is necessary to remove the majority of the water as close to the mining site as possible. Generally a solids content of greater than 50% is desired. To put this problem in its most dramatic perspective 18 tonnes of water would have to be removed from 20 tonnes of such peat as mined in order to produce 2 tonnes of 50% moisture content peat. The energy contained in the final product is much less than that required to remove 18 tonnes of water and as a result it is not practical to use direct thermal means involving evaporation of the water to prepare the dry peat.

Peat as found in nature has undergone varying stages of biological decomposition. Peat is formed by microorganisms from plants of lignocellulosic nature. According to the extent of the decomposition it is possible to recognize the nature of the lignocellulosics originally present. It is thus normal to find remnants of hemicelluloses, some sugars, cellulose, lignin, peptides and newly created materials obtained via the microorganisms' action. Metals are normally complexed to these macromolecular structures indicating a possible role during the decomposition.

The structure (three-dimensional) of peat is not yet known with certainty although the following picture should approximate the actual arangement:

a central core of humic materials, highly hydroaromatic, derived most likely from lignin and cellulose degradation;

the core consists of phenolic-like monomers bridged via 0 bonds and adopting, for entropy reasons, a coiled position;

a very large number of OH groups impart their hydroaromatic nature to this core;

attached to this central core via hydrogen-bonds are:

carbohydrates, mainly of cellulosic nature although in some cases the hemicelluloses might have contributions peptides, contributing a significant percentage to the total N present in peat inorganic matter either entrapped or ion-exchanged (metals)

resins and waxes derived from the plant liptinitic material and probably absorbed via some H-bonds to the central core The hydrophilic nature of peat should thus be attributed to the extraordinary capacity of the material towards H-bonding.

In well decomposed materials the fibrous character of the cellulose remnants is almost non-existent. The overall peat structure becomes highly colloidal in an environment somewhat acidic whose pH varies between 3 and 6, although normally it is between 4 and 6.

Peat that has only lightly decomposed still contains recognizable plant debris and is often sold as horticultural peat. The von Post scale is used to describe the extent of decomposition and has limits of 1 and 10. Peats for energy purposes are generally of von Post values of 5 or greater. Such peats are very decomposed and have a colloidal structure which makes it very difficult to simply press the water mechanically from the peat and water matrix.

In countries with appropriate climates—long frost free periods, adequate and predictable periods of dry/sunny/windy weather—a solar drying method based on milling or extruding the peat on the prepared surface of the bog is possible. This is practiced on a large scale in the USSR, Finland, Sweden and Ireland. The Canadian peat moss industry uses similar methods but the short seasons can only be justified for a premium product such as horticultural peat moss.

Where climates are more severe and there is an application for peat such as energy which requires almost year round operation, thermal treatments have been proposed which exploit the thermal/mechanical rearrangement of the peat/water matrix in order to have the bulk of the water drain from the matrix by, for example, filtration followed by thermal drying.

Processes of thermal rearrangement and mechanical treatment of peat are known. A semi-commercial plant using such a process for example was in operation around the end of World War I in Dumfries, Scotland.

More recent processes include derived fuel processes (PDF) and the Koppelman process.

The PDF process is a wet carbonization treatment of peat at 200° C., 2.5 MPa and residence times of 30 minutes. Specially designed heat exchangers and multiple-effect condensor-evaporators are used for efficient heat recovery to provide a thermal efficiency estimated between 72% and 80%. The wet carbonized peat slurry is dewatered to 50 weight percent moisture in semi-continuous and fully automatic pressure filters. The filter cake is then pulverized and further dried to about 10 weight percent moisture in a flash dryer. The dried peat is then pelleted and briquetted.

The Koppelman process, described and illustrated in U.S. Pat. No. 4,477,527 issued Oct. 16, 1984, is a two-stage, high temperature, high pressure beneficiation process giving a K-fuel product with a heating value about 50% greater than that of the raw peat. The first stage is a wet carbonization under conditions similar to the PDF process followed by filtration to 70 weight percent moisture. The dewatered peat is conveyed by a twin-screw feeder to the second stage operating at 400° C. and 10.4 MPa for a residence time of 10 minutes. The peat is extruded and cooled giving a K-fuel product with less than 10 weight percent moisture.

A useful criterion for assessing the utility and practicality of such processes is a measurement of the "severity" of the process. The parameter that reflects severity of such a process is a "P" factor which is calculated as follows:

$$P = \text{duration of treatment} \times \exp \frac{(T_{reaction} - 100)}{(14.75)}$$

Where T reaction is the reaction temperature of the peat.

The severity of a typical PDF process and a typical Koppelman process is set out in Table I hereafter.

TABLE I

| Process | Temp/C. | Time Min. | Mass Yield % | Heating Ratio* | "P Factor" min |
|---|---|---|---|---|---|
| PDF | 210 | 30 | 60 | 1.21 | 52000 |
| Koppelman | 320 | 15 | 40 | 1.22 | 450000 |

*The heating ratio is the ratio of the higher heats of combustion of the product over those of the input peat.

It can be seen from the above Table that the existing PDF and Koppelman processes use long duration treatments and obtain a dewaterable product in reduced yield due to their high severity. This causes solubilization of a large amount of the peat and this in turn is costly with respect to the water treatment. The long duration treatment results in low throughput unit of investment.

Other processes of dewatering peat, either being wet carbonaceous processes or processes using heat and high-pressure in combination, are described and illustrated in U.S. Pat. No. 2,573,134 of Gebaurer issued Oct. 30, 1951, U.S. Pat. No. 2,668,099 of Cederquist issued Feb. 2, 1954, U.S. Pat. No. 4,153,420 of Myreen issued May 8, 1979 (corresponding to Canadian Patent No. 1,119,407 issued Mar. 9, 1982) and Canadian Patents Nos. 188,789 of ten Bosch issued Feb. 18, 1919 and 208,415 of ten Bosch issued Feb. 8, 1921. Again, such processes use long duration treatments and have high severity.

Finally, a recently developed Russian hydrolyzer process has been used in the production of sugars (apparently fermented to single cell protein). This process is not intended for dewatering of peat. This process, developed at the Institute of Wood Chemistry in Riga, is intended to process peat (slightly decomposed i.e. von Post 1-2 humification) so that a fermentable juice for the production of a single cell protein is obtained. That process involves:

milling peat.

drying peat in an oven.

mixing dried material with concentrated sulphuric acid in a proportion ranging from 1.5 to 3 g $H_2SO_4$/100 g of dry peat.

the mixed material is then extruded through a screw-type reactor where intensive shear forces break down the polymeric structures causing substantial hydrolysis.

the mass then enters a reactor where it is diluted with $H_2O$ and steam is added to heat the slurry thus formed. The slurry must thus be heated to about 140° C.-190° C. where solubilization of the sheared polymers and its final hydrolysis to monomers is conducted.

A disadvantage of the Russian technology is that it requires drying the initial peat which makes it unsuitable as a dewatering process.

Modification of the Russian technology to process wet highly decomposed material seems improbable since, once macerated, the wet material acts as a fluid not permitting any extrusion.

From the Russian experience, however, it is realized that extensive hydrolysis is possible and relatively easy to carry out.

OBJECTS OF THE INVENTION

It is an object of the present invention to provide a novel peat dewatering process having low severity for use in conjunction with the wet mixing of peat. It is a further object of the present invention to provide such a process which will produce, from even extremely wet raw peat, a peat product that can be easily dewatered in a filter press of values to 50% to 60% water content using relatively low thermal energy and with relatively minimal solubilization of solids.

SUMMARY OF THE INVENTION

In accordance with the present invention there is provided a process for dewatering peat comprising the steps of:

(a) flowing a slurry of macerated peat through a reactor directly heated by the addition of live steam, (b) subjecting the heated mass in the reactor to intense mechanical shear and (q) quenching the product from the reactor.

In a preferred embodiment of the invention, the slurry in the reactor is heated to a temperature in the range of about 160° C. to 200° C. and is subjected to mechanical shear and post hydrolysis for a time of between about 1 to 3 minutes. The mechanical shear is preferbly achieved by passing the peat slurry through narrow orifices in a nozzle means in the reactor, the size of the orifices being such that flow profiles willbe developed in the slurry to break apart the stretched polymers of the peat and thereby facilitate the hydrolytic process.

It has been found that the process according to the present invention produces conditions of low severity as defined by the "P Factor" of values less than 1,000. As well, the product produced according to the process of the present invention can be easily dewatered in a filter press to values of 50% to 60% water content.

BRIEF DESCRIPTION OF THE DRAWINGS

These and other objects and advantages of the invention will become apparent upon reading the following detailed description and upon referring to the drawings in which.

Figure 1:
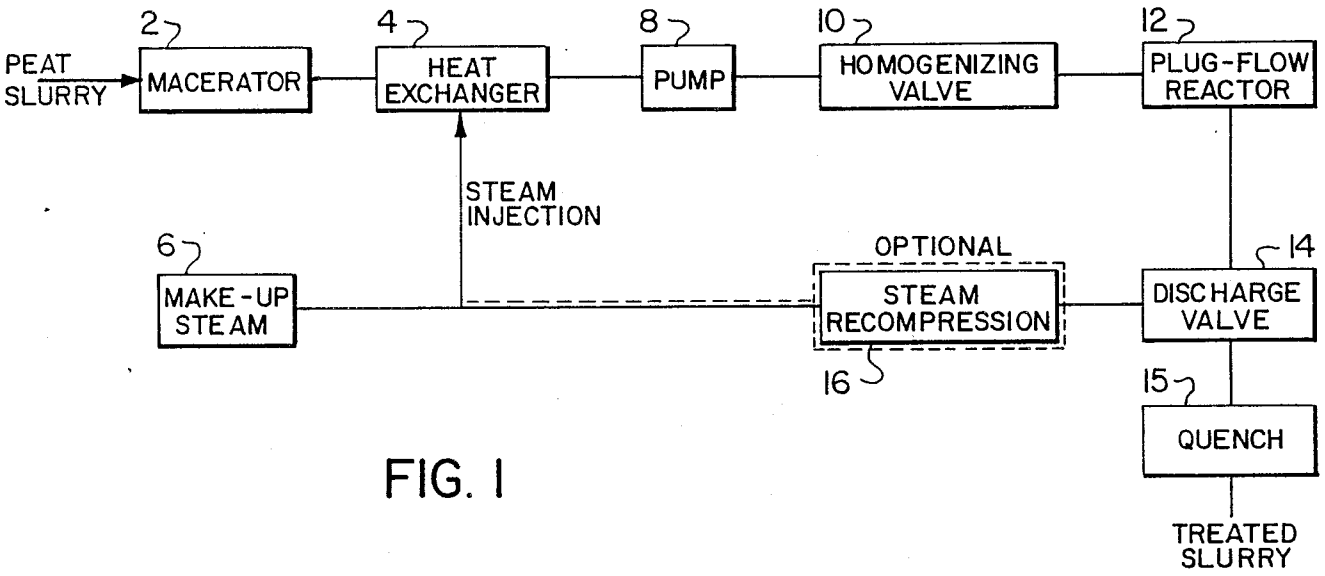
FIG. 1 is a schematic flow chart of the process according to the present invention.

While the invention will be described in conjunction with example embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

Turning to FIG. 1 there is illustrated a schematic flow sheet of the low severity peat dewatering process in accordance with the invention. In the process, raw peat, which peat may for example contain less than 5% solids (but wich is more normally concentrated to about 10%–15% solids using classical mixer/settler technology), is macerated and made into a slurry at macerator 2. The slurry is passed through a heat exchanger 4 where steam from a source 6 is injected to appropriately heat the slurry, e.g. to 160° C. to 240° C., and preferably 160° C. to 200° C. The heated slurry is then pumped by means of pump 8 through an homogenizing valve 10 where it is subjected to intense mixing mechanical shear and then passed along a plug flow reactor 12. The peat product from the reactor 12 is then passed through discharge valve 14 into a quench bath 15 and recovered for subsequent treatment, such as centrifuging and pressing to produce peat of a desired moisture content (e.g. 50% to 60%). The time for the slurry in passing through homogenizig valve 10 until it is quenched, may be from about 1 to 3 minutes. Steam flashed during the quench process may optionally be recovered and compressed at 16, and used as steam for injection to heat exchanger 4.

Figure 2:
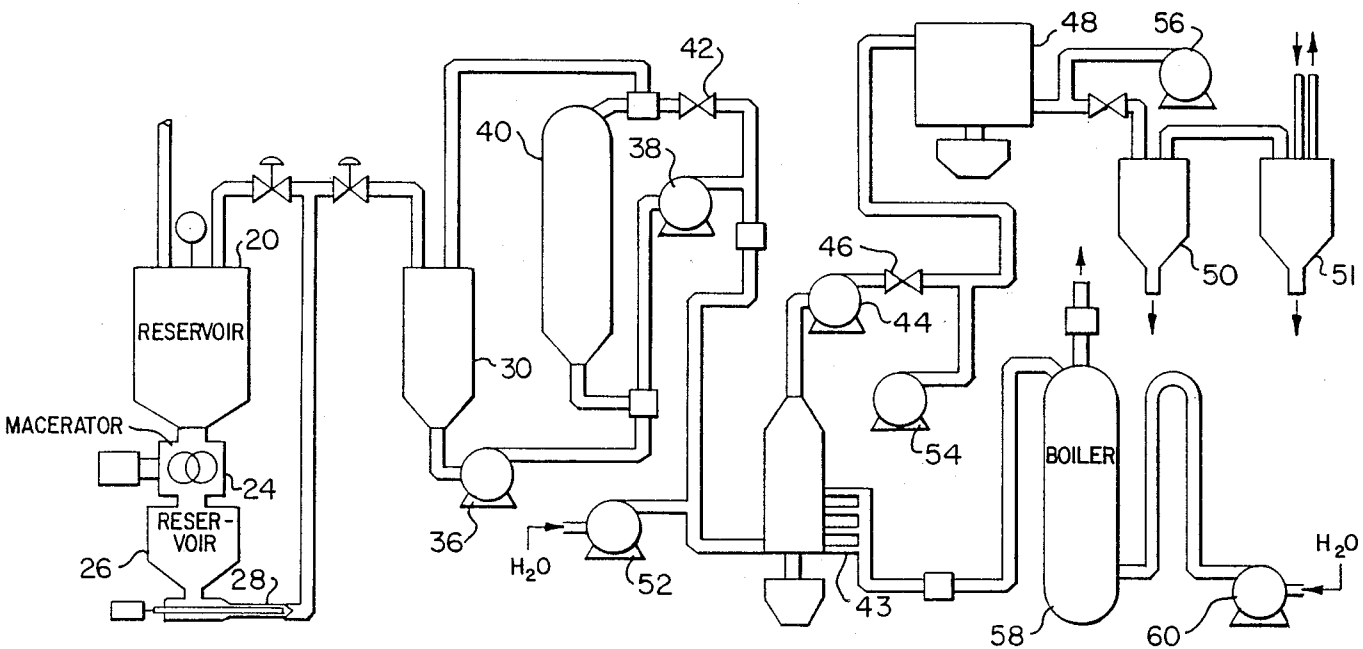
FIG. 2 is a more detailed schematic flow chart, illustrating typical operating conditions, of the process of FIG. 1.

An example installation for carrying out the process of the present invention is depicted schematically in FIG. 2. Raw peat, to be macerated, is passed from reservoir 20 through a Seepex (trade mark) macerator 24 into reservoir 26. As required, macerated peat slurry held in reservoir 26 is passed by means of pump 28 to reservoir 30 and then, by means of high pressure Seepex (trade mark) pump 36, to the homogenizing valves 42 and 46. A linear flow rate of peat suspension through the system of 0.1 to 0.4 cm/s has been found to be suitable.

During maceration, proper screening of stones and hard granular material is required. In this regard macerated peat suspensions may be screened, for example through a 2 mm screen opening prior to entering the pumps. Prior to maceration, the peat may be screened to remove stone and debris which could damage the macerator itself.

The continuous processing of the peat suspension is conducted as follows:

the peat from macerator 24 is passed to reservoir 30;

high-pressure Seepex (trade mark) pump 36 feeds recirculating pump 38 (e.g. 10 liters per minute) which also aspires some of the material accumulated in reservoir 40;

while the recirculation takes place around pump 38, a first "cold" homogenizing treatment (e.g. less than 100° C.) takes place with valve 42 (typically pressure differentials of 4.1 to 5.5 MPa are used for this stage);

a fraction of the peat suspension (1 liter/min approximately) is sent to pump 44 via a mixer/heat exchanger 43 where steam is injected to raise the temperature of the peat suspension to the desired level;

a second homogenizing treatment can take place through valve 46 at the pre-established temperature level (e.g. at a temperature in the range of about 160° C. to 240° C.). A pressure differential of about 24.8 MPa is maintained through valve 46 when in use;

a tubular reactor 48 of varying length completes the treatment at the pre-established temperature level before quenching. The length is chosen to give the appropriate level of severity as defined by the P factor, e.g. at 190° C. and an 88 sec. residence time in reactor 48, the P factor is 655;

flashing and discharge takes place at quench receiver 50, where the peat suspension is then passed, bringing its temperature down to about 100° C. or less; and steam condensation, if wanted, is conducted at vessel 51.

The solids concentration of the peat suspensions processed using such a system varied between 12.3% and 13.7% by wt.

For homogenizing valve 46 to be used in accordance with the present invention to create high shear on the peat, any standard type homogenizing valve for example as used in the dairy industry may be used. Such valves for instance are made by A.P.V. Gaulin.

In addition, in FIG. 2, water pump 52 is used to bring the system to the desired temperature, and acid injection pump 54 and base injection pump 56 are included for use, if needed (although it has been found in experiments conducted using apparatus in accordance with FIG. 2 that no acid or base addition to the peat was required).

Steam is produced at boiler 58 for heat exchanger 43 and water is pumped by pump 60 to boiler 58 as required.

The peat product from quench receiver 50 may then be subsequently processed, for example by centrifuging and/or pressing.

Figure 3:
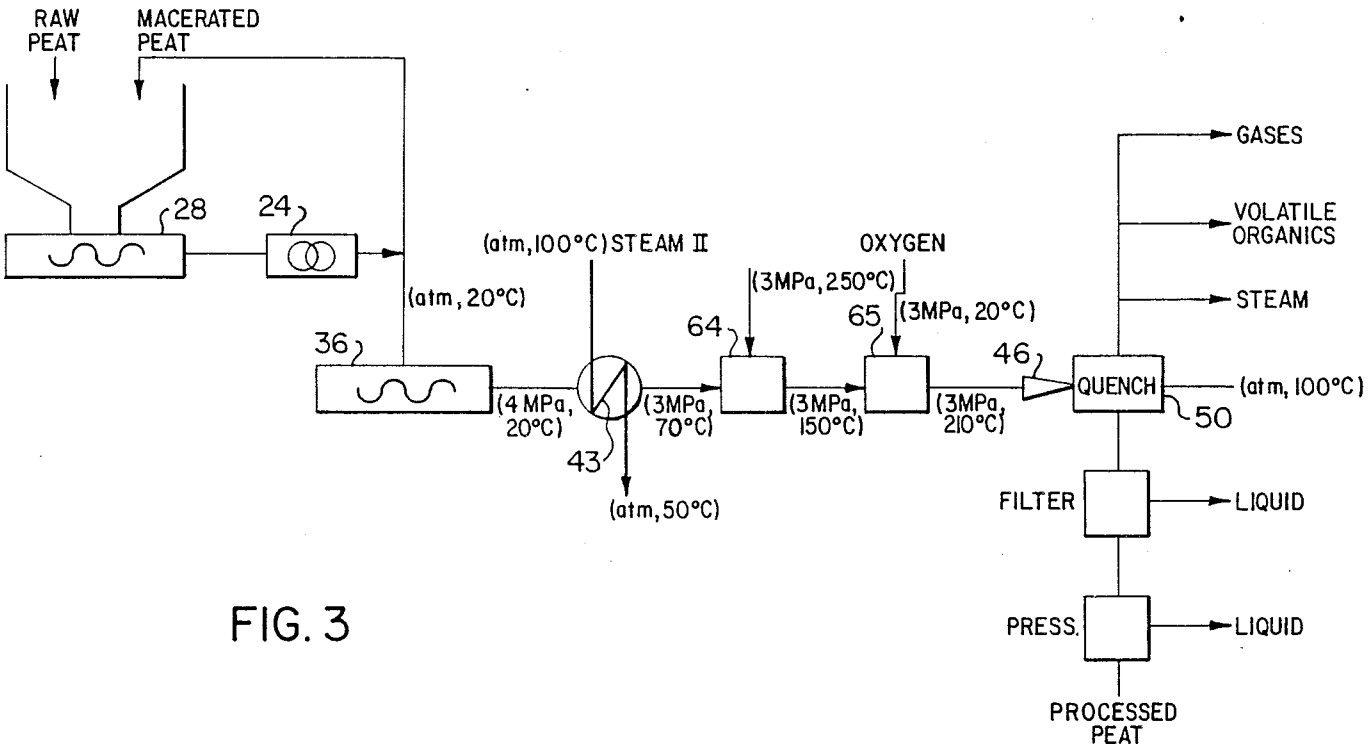
FIG. 3 is a schematic diagram illustrating in greater detail the components of the reactor of the present invention.

Turning to FIG. 3 there is illustrated a flow sheet illustrating typical operating conditions for an example embodiment of the peat dewatering process of the present invention. Pressure and temperature conditions at the various stages of the process are illustrated. In the embodiment illustrated in FIG. 3, the treatment consists of steam injection followed by oxygen injection into mixers 64 and 65 prior to passage through an homogenizing valve 46 and followed by quenching at 50. An alternative approach would be to use steam only and a temperature of around 190° C. to 210° C.

The quenching step in the present invention is extremely important because, by bringing the temperature rapidly from the 160° C. to 240° C. range to 100° C. or lower, this quickly terminates the hydrolytic and other reactions which have been taking place in the peat suspension from the time it has passed through the homogenizing valve. This permits better control of these reactions, to maximize solids content recoverable after quenching.

It should be noted that the low severity of the process in accordance with the present invention is derived from the relatively short reaction time between passage of the peat slurry through the homogenizing valve 10 (FIG. 1) until it is quenched. This time may be as little as 2 minutes and the quench time itself may be less than 1 second. Preferably the peat slurry is quenched after th slurry has accumulated a total P factor, P of between 500 and 1500 minutes.

Until the quenching step, it is important in carrying out the process of the present invention to ensure that the pressure at any point of the process is greater than that for saturated steam at the temperature of that point.

EXAMPLE

Peat from the Farnham Bog (Quebec, Canada) was made into a peat slurry by mixing the peat as received with water in order to obtain an 13.5% solid concentration. The process configuration was that of FIG. 2. The mixing was ensured by macerating with a Seepex (trade mark) macerator 24 (of FIG. 2) in the loop described by macerator 24, reservoir 26, Seepex pump 28 and back to vessel 20. The pre-macerated slurry was then utilized by pumping it at a rate of about 1 kg/min. of slurry to the reactor loop 36, 40, 30 for a cold homogenization prior to introduction to the mixer/heat exchanger 43.

The final quenched material was filtered in a small scale press to solids concentration of 44%–48%. Aliquots of the treated slurry were also subjected to assessment in the laboratory as described below.

The thermally treated slurry was filtered in a Buchner filter kit using a Whatman (trade mark) #40 filter paper. One 20 gr-aliquot of the wet pressate was used to determine the extent of dewatering reached.

This 20 gr-aliquot was introduced in a press consisting of a 50 mm-diameter piston. After having applied a 500 psig load (3.45 MPa) on the piston, the residual pressure was recorded after 1 minute and immediately readjusted at the 500 psig load. This procedure was repeatedly done until no further changes in pressure were detected.

Ultimate analyses of the air-dried residues were made to determine the extent of the severity of the treatment. These analyses were performed used an elemental analyzer (Perkin Elmer, model 240C). Table II sets out results obtained using this system at varying temperatures of peat slurry in the primary receiver.

TABLE II

| Process | Temp/ C. | Time Min. | Mass Yield % | Heating Ration* | "P Factor" min | Solids Content % |
|---|---|---|---|---|---|---|
| UdS/ | 175 | 1.47 | 81 | 1.07 | 237 | 42.7 |
| NRC | 190 | 1.47 | 72 | 1.10 | 656 | 46.4 |
| | 210 | 1.47 | 72 | 1.10 | 2541 | 48.2 |

*The heating ratio is as defined above in Table I but in this instant is estimated from the change in elemental composition.
The product peat from these experiments was pressed to a moisture content 50%–60%, a level very suitable for thermal drying.

In repeated processing of peat slurry according to the above method at different temperatures, a recovery of more than 85% of the initial solids was achieved at temperatures below 180° C. For temperatures between 180° C. and 235° C., the recoveries dropped to c.a. 60%. Beyond 235° C., it was merely 50%.

From the above-noted tests, it has been determined that the reduction of water content in peat is readily achieved down to about 55% by simple maceration followed by passage through the homogenizing valve, quenching and pressing. The important effect of that treatment is to shorten pressing time.

Thus it is apparent that there has been provided in accordance with the invention a process for dewatering peat that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What we claim as our invention:

1. A continuous process for dewatering peat comprising the steps of flowing a slurry of peat through a reactor directly heated by the addition of live steam to heat the slurry to a temperature of between 160° C. to 200° C., subjecting the heated slurry to intense mechanical shear and mixing, and then, after a period of between 1 to 3 minutes, quenching the product.

2. A process according to claim 1 which comprises first macerating raw peat to a slurry.

3. A process according to claim 1 comprising the further step of subjecting the peat product after quenching to mechanical pressing to produce peat of a moisture content of 50% to 60%.

4. A process according to claim 1 wherein the peat is subjected to intense mechanical shear and mixing by passing it through an homogenizing valve.

5. A process according to claim 1 wherein the temperature of the product is brought to about 100° C. or less by quenching.

6. A process according to claim 5 wherein the peat slurry is quenched after the slurry has accumulated a total P factor P of between 500–1500 minutes.

7. A process according to claim 6 wherein the duration of treatment is about 1.5 minutes and the reaction temperature is about 190° C.

* * * * *